US009205474B2

(12) United States Patent
Corti

(10) Patent No.: US 9,205,474 B2
(45) Date of Patent: Dec. 8, 2015

(54) DEVICE FOR APPLICATION TO METAL MATERIAL EXTRUDING PRESS ASSEMBLIES FOR QUICKLY REPLACING A HEEL ELEMENT AND/OR A SLOTTED TIE-ROD ELEMENT IN THE PRESS ASSEMBLIES

(75) Inventor: Giovanni Corti, Vimercate (MB) (IT)

(73) Assignee: PRESEZZI EXTRUSION S.P.A., Vimercate (MB) (IT)

( * ) Notice: Subject to any disclaimer, the term of this patent is extended or adjusted under 35 U.S.C. 154(b) by 805 days.

(21) Appl. No.: 13/558,269

(22) Filed: Jul. 25, 2012

(65) Prior Publication Data

US 2013/0025103 A1 Jan. 31, 2013

(30) Foreign Application Priority Data

Jul. 26, 2011 (IT) ..... MI11A1388

(51) Int. Cl.
*B21C 26/00* (2006.01)
*B21C 25/04* (2006.01)

(52) U.S. Cl.
CPC ..... *B21C 26/00* (2013.01); *B21C 25/04* (2013.01); *Y10T 29/5383* (2015.01)

(58) Field of Classification Search
CPC .... B21C 23/21; B21C 23/211; B21C 23/215; B21C 25/04; B21C 26/00; B29C 33/305; B29C 33/70; B29C 33/74; Y10T 29/5383
USPC ..... 72/264, 265
See application file for complete search history.

(56) References Cited

U.S. PATENT DOCUMENTS

| | | | | | |
|---|---|---|---|---|---|
| 2,184,048 | A | * | 12/1939 | Krause | 72/273 |
| 3,080,201 | A | * | 3/1963 | Escola | 138/89 |
| 3,123,215 | A | * | 3/1964 | Zilges et al. | 72/265 |
| 3,277,692 | A | * | 10/1966 | Gettig | 72/480 |
| 3,411,337 | A | * | 11/1968 | Murphy et al. | 72/264 |
| 3,475,942 | A | * | 11/1969 | Long et al. | 72/265 |
| 3,651,680 | A | * | 3/1972 | Groos | 72/265 |
| 3,732,716 | A | * | 5/1973 | Robra | 72/273 |
| 3,827,271 | A | * | 8/1974 | Kishino et al. | 72/273.5 |
| 4,399,676 | A | * | 8/1983 | Noyori et al. | 72/40 |

FOREIGN PATENT DOCUMENTS

| | | | | | |
|---|---|---|---|---|---|
| GB | 902555 | A | * | 8/1962 | B21C 25/04 |
| JP | 3-169426 | A | * | 7/1991 | B21C 26/00 |
| JP | 4-162915 | A | * | 6/1992 | B21C 29/04 |

* cited by examiner

*Primary Examiner* — Edward Tolan
(74) *Attorney, Agent, or Firm* — Hedman & Costigan, P.C.; James V. Costigan; Kathleen A. Costigan

(57) ABSTRACT

An improved device for application to metal material extruding press assemblies, for quickly replacing a heel element and/or a slotted tie-rod element applied to the press assemblies, characterized in that said device comprises a hydraulic cylinder for driving the slotted tie-rod element and that said heel element supports an auxiliary hydraulic or pneumatic cylinder having a recess for engaging therein a rear end portion of said slotted tie-rod element and that said auxiliary cylinder comprises an auxiliary cylinder pushing piston designed for performing a longitudinal translation and rotary movement thereby allowing said slotted tie-rod element and/or heel element to be assembled and disassembled.

15 Claims, 7 Drawing Sheets

DEVICE FOR APPLICATION TO METAL MATERIAL EXTRUDING PRESS ASSEMBLIES FOR QUICKLY REPLACING A HEEL ELEMENT AND/OR A SLOTTED TIE-ROD ELEMENT IN THE PRESS ASSEMBLIES

BACKGROUND OF THE INVENTION

The present invention relates to an improved device for application to metal material extruding press assemblies.

The inventive device allows a quick replacement of a heel element and/or a slot tie-rod element in said press assemblies, which elements must be replaced as they are worn.

As it is known, metal extruding press assemblies are used for extruding metal billets at an extruding temperature of about 400° C., through press pistons applying a high pressure on a heel element pushing the billet into an extruded die.

The extruding operations are performed in a quick operating succession and thereby the press operating members are greatly stressed by thermal and mechanical efforts; accordingly the heel element quickly wears and must be necessarily replaced after a set number of extruding operations, usually after 20,000-40,000 extruding operations which, as stated, are performed in a quick operating succession.

It is moreover known that metal material extruding press assemblies have a high cost, thereby they are operated for 24 hours a day, without interruptions, to amortize their cost.

Up to now, the heel element replacement operations were very difficult and required long replacement time with the press assembly not operating.

Thus, the replacement of metal material extruding press assembly heel elements has been considered a very delicate operation so far, both with respect to the press operator safety standpoint and to an optimizing of the required press maintenance or servicing operations, which maintenance operations are very difficult due to the following reasons:

a) the temperature of the heel element to be removed and that of the replacement one is of at least 400° C.;

b) the weight of the heel element depends on the press assembly size and is of several dozens of kilograms, thereby the heel element must be disassembled and assembled by an auxiliary lifting equipment comprising a tackle or a idle roller lifting device.

Moreover, it is not possible to access the press assembly, because of the dangerous press driven elements.

As it is moreover known, the heel element is usually clamped to a large size threaded tie-rod having a diameter from about 40 mm to about 100 mm for large press assemblies.

Thus, it is very difficult to turn the heel element to screw on said heel to the press punch.

For example, with a threaded tie-rod having a diameter of 90 mm, pitch 3, a length of 100 mm, it is necessary to perform about 33 rotary movements (100/3) to screw off the heel element being replaced and a corresponding number of rotary movements to screw on the replacement heel element, thereby it is very difficult to clamp the heel element to its threaded tie-rod by simple clamping operations.

In fact, it is very difficult to lock, with a required locking force, a round cross section heel of a weight of several dozens of kilograms, and including a threaded portion, thereby it is necessary to use movable hammer and sectorized torque wrench assemblies.

Moreover, no dynamometric or hydraulic torque wrench assemblies for facilitating said clamping operations exist at present, thereby the clamping force is applied in a very approximated manner.

Thus, during the replacement operation, the heel element may be accidentally detached and damage the press assembly.

Other heel elements are attached by a bayonet attachment, of a Castol type or the like, which attachment system, while having some operating advantages, has also great disadvantages.

An advantage is that, for attaching the heel element, it is necessary to turn it through only 45°.

A disadvantage is that it is not possible to lock the replacement heel element with a zero clearance, since an operating clearance between the bayonet assembly head and the related seat is always present, which clearance is negatively affected by thermally changing conditions always present in such a press assembly.

Another factor negatively affecting this attachment operation is a clearance increase or growth due to wear and frequent pulling and releasing operating cycles.

The inventive device facilitates and speeds up the heel element replacement operations, independently of the fact that either the replacement heel element is brought manually to a desired position, by a tackle, or is brought to said target position by a further automatically operating handling device.

In the inventive device, the replacement heel is brought to said target position, i.e. in front of the press punch, and is threaded on the rod up to achieve a mechanical abutment.

Then the slotted tire-rod is turned through 30°, while controlling and limiting the tie-rod torque.

If a precise target position is not achieved, then the tie-rod does not further turn, thereby a related end of stroke element does not arrive at said target position, causing the press to provide an alarm signal preventing any further operating steps.

As the control end of stroke or limit assembly arrives at the target position, the inventive device is automatically switched to a following operating step, that is the tie-rod pulling through a hydraulic cylinder.

A reverse operation will be performed when the heel element must be disassembled.

On the other hand, if the tie-rod must be disassembled, then it is necessary to perform a rotary 45° movement with respect to a zero position, to axially disengage the tie-rod and unthread it from the press punch.

For assembling the tie-rod, an opposite operation must be carried out, by performing a 45° rotary movement of the rod with respect to the zero position, to disengage it from the punch.

Thus, the system has three rotary positions all controlled by the end of stroke or limit assembly, which positions are:

1. a locked heel element position;
2. an unlocked heel element position;
3. an unlocked tie-rod position.

BRIEF DESCRIPTION OF THE DRAWINGS

The above mentioned and other functional and constructional features of the inventive improved device for automatically locking a heel element and/or a tie-rod in a hydraulic metal extruding press assembly according to the invention will become more apparent hereinafter from the figures of the accompanying drawings, where.

DESCRIPTION OF THE PREFERRED EMBODIMENTS

Figures 1, 2:
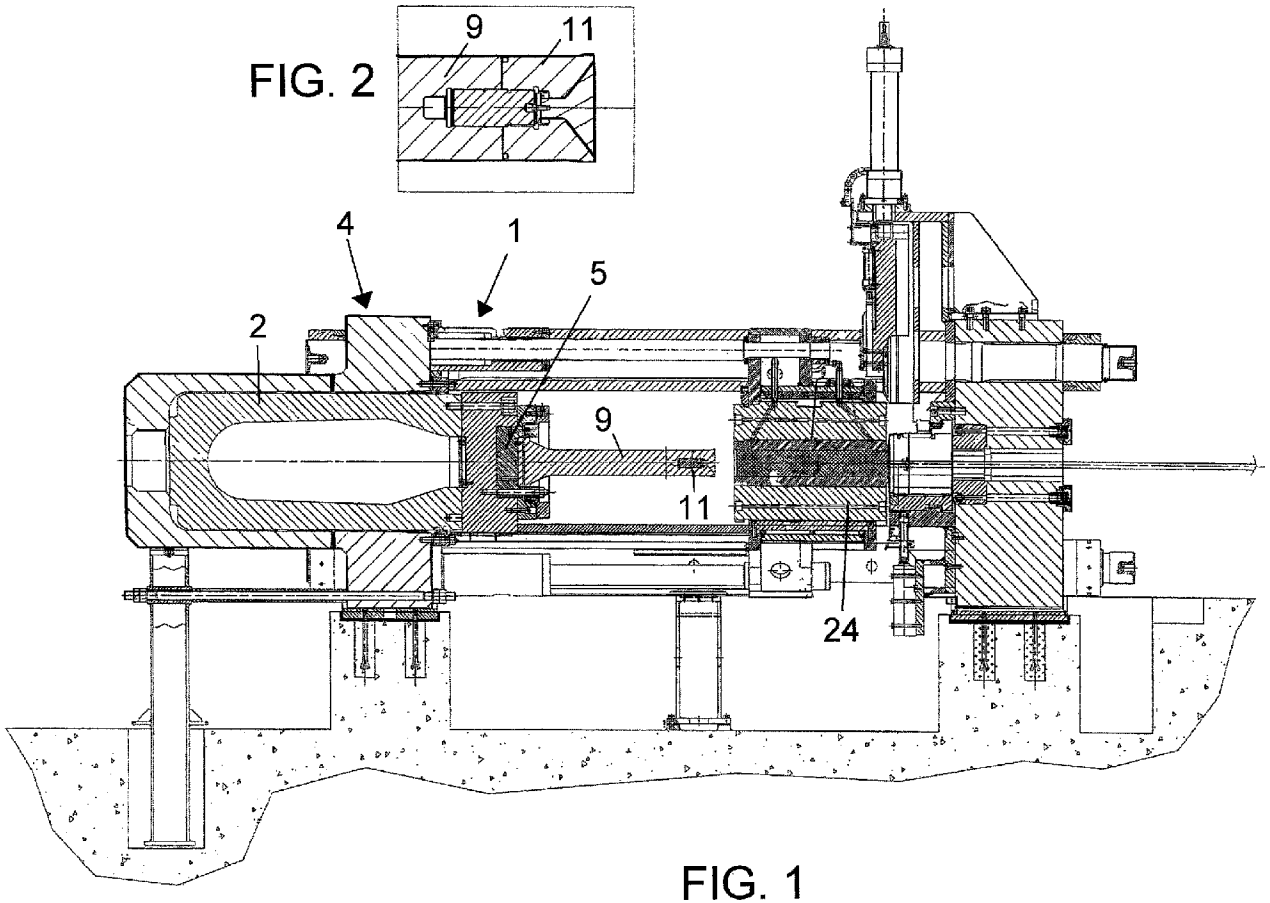
FIGS. 1 and 2 show two cross sectioned side views of a press assembly including a prior threaded tie-rod element and heel element.
Figure 3:
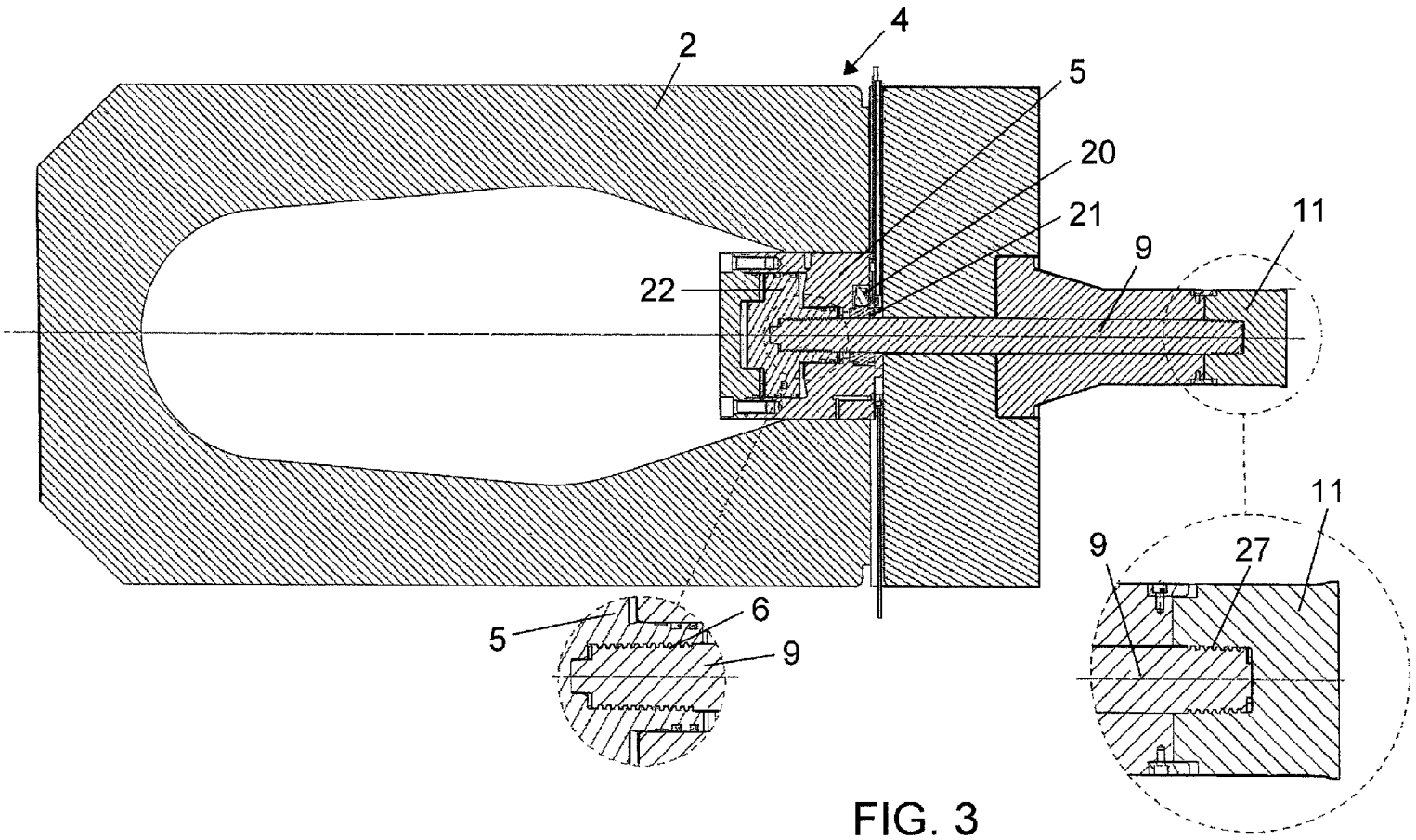
FIG. 3 shows the main cylinder of the inventive hydraulic press and the press punch rod, the heel element applied to said rod and an auxiliary cylinder causing said rod to perform a feeding and withdrawing movement, for replacing the tie-rod and/or heel element.
Figure 4:
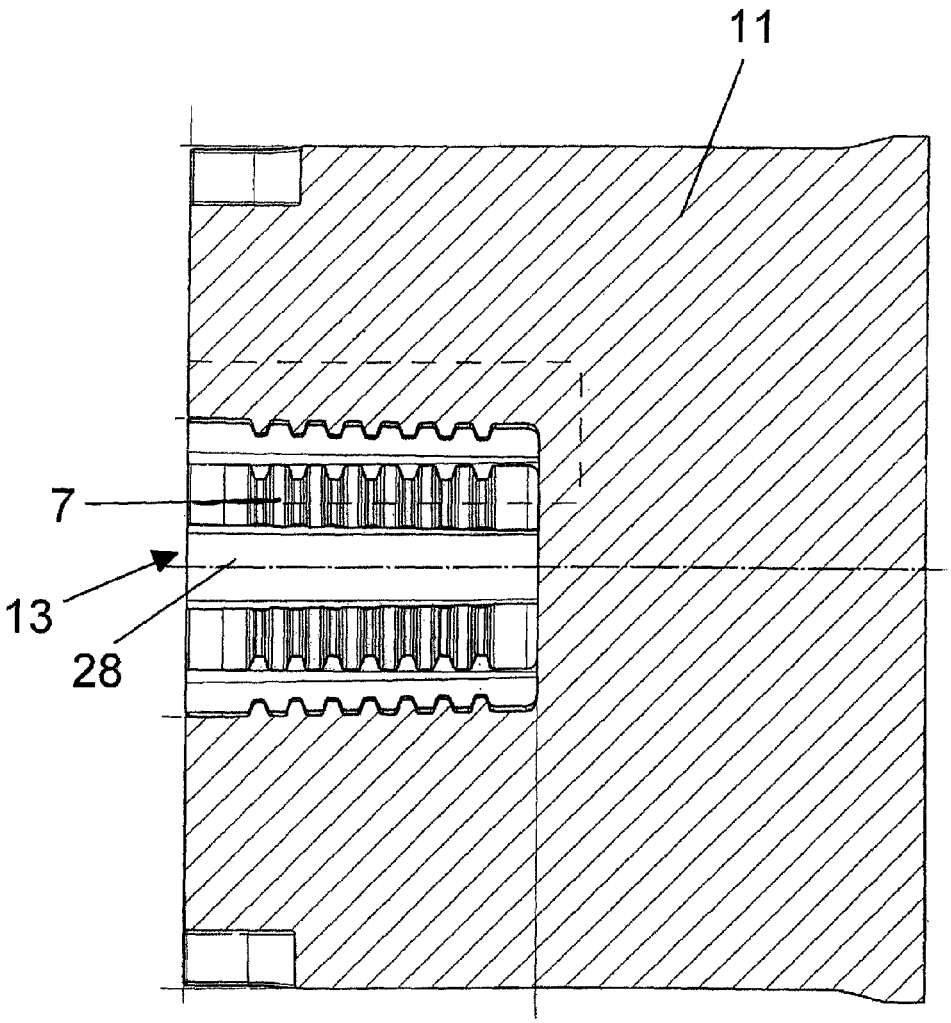
FIG. 4 shows the slotted heel element including a plurality of parallel tooth elements and to be applied to a slotted tie-rod.
Figure 5:
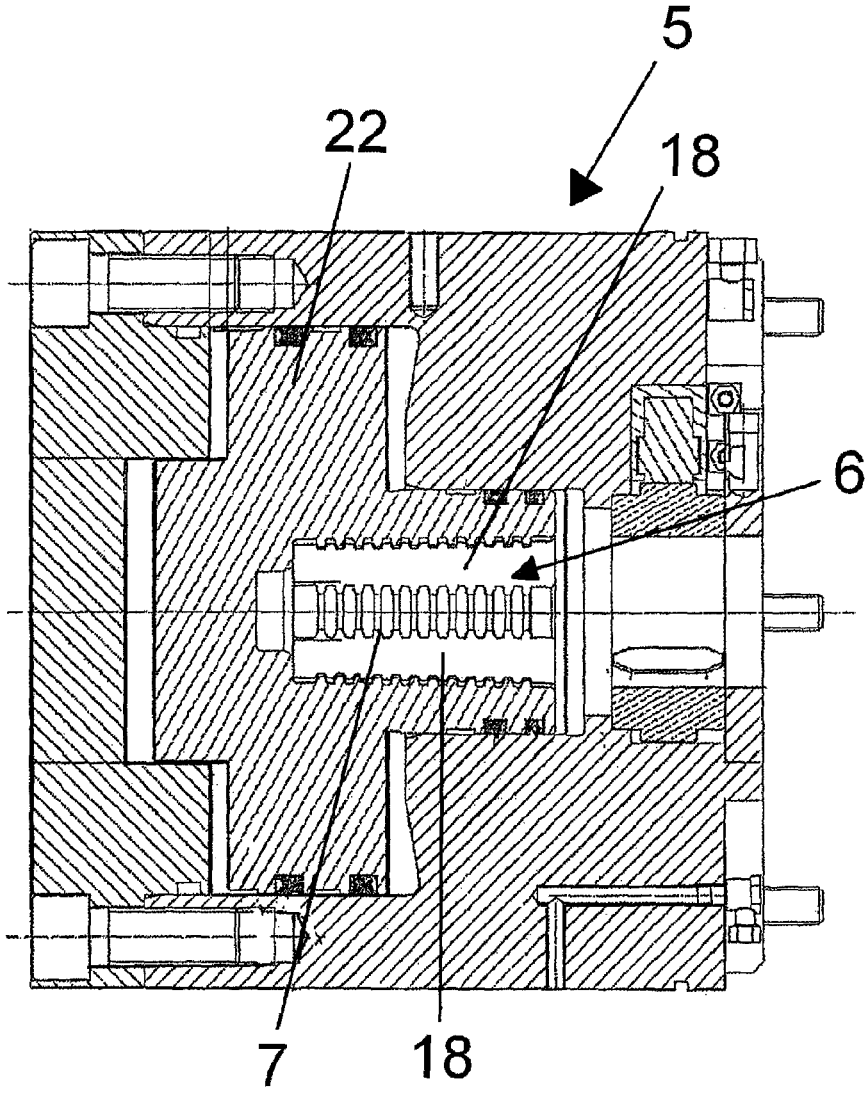
FIG. 5 shows a detail view of an auxiliary piston which may axially slide, but the rotary movement of which is locked. The tie-rod, through a 30° rotary movement, disengages the heel element (which is assembled at an end portion thereof), and through a further 45° rotary movement disengages from the piston slot, thereby it may be disassembled.
Figure 6:
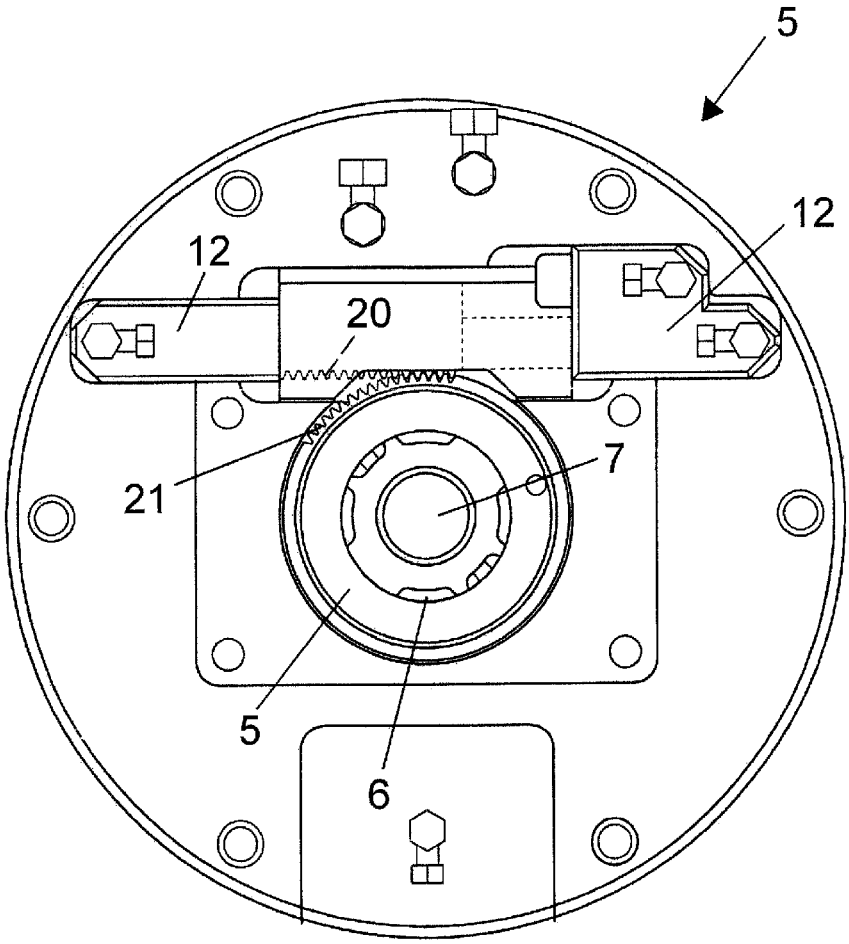
FIG. 6 shows an auxiliary cylinder axially driving a rack, in turn rotatively driving through 30° or 45° a gear, and a further gear at a center portion of which the slotted rod 9 is housed.
Figure 7:
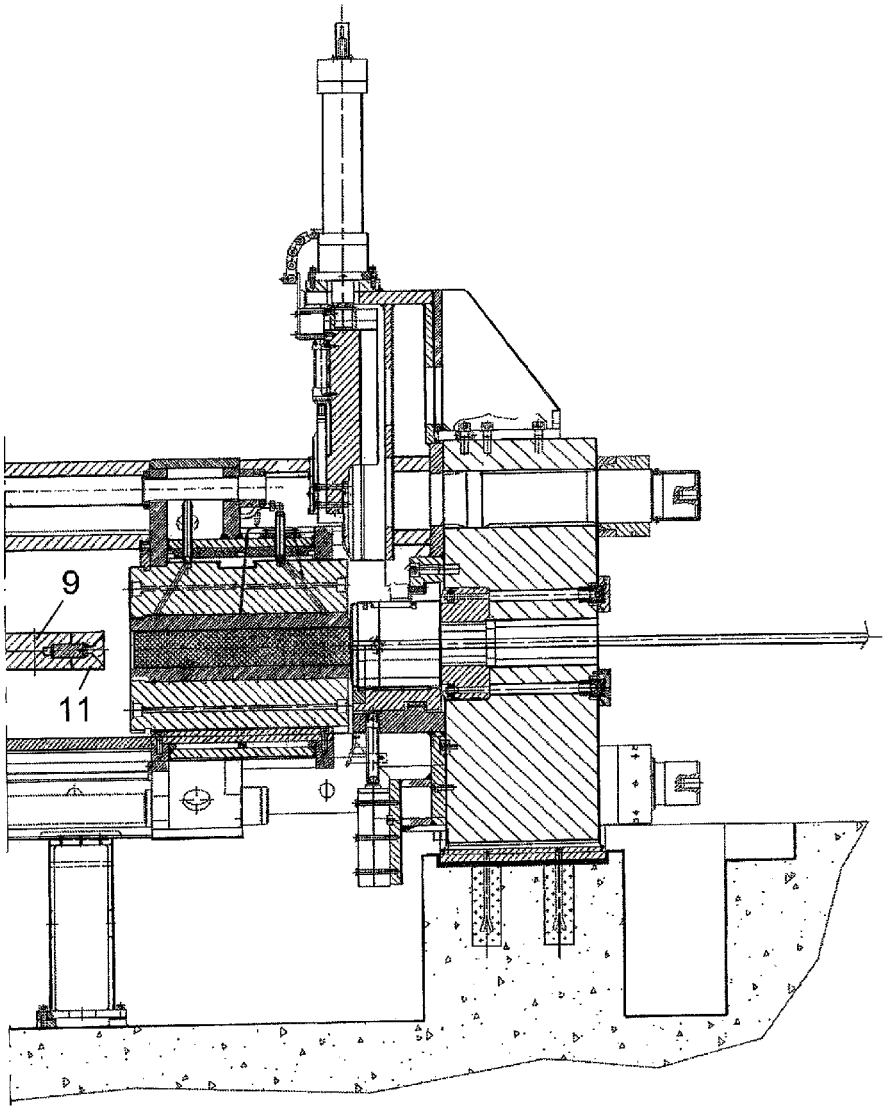
FIG. 7 shows a seat or recess for holding a billet and a die for extruding said billet.
Figure 8:
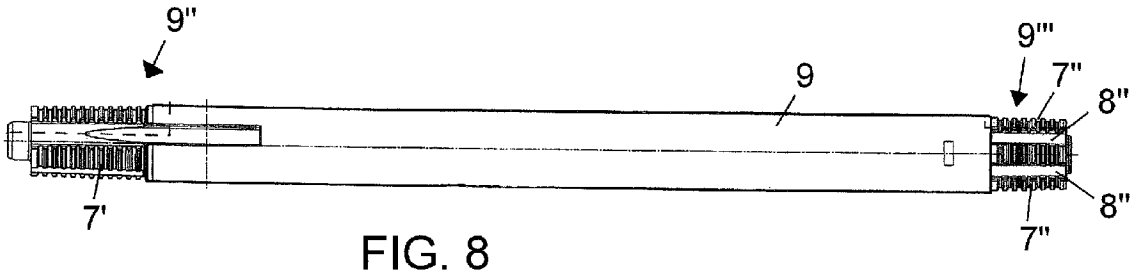
FIGS. 8 and 9 show a rod 9 including a plurality of parallel tooth elements, at the two end portions thereof, and longitudinal cavities for allowing an easy front clutch connection of the tie-rod 9 in its housing and restraining seat or recess.
Figure 10:
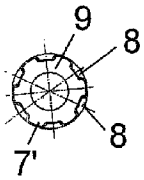
FIGS. 10 and 11 are respective cross sectional views showing the slotted tie-rod at its two front and rear portions, respectively.
Figure 11:
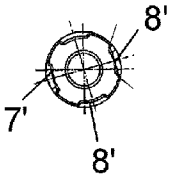
Figure 9:
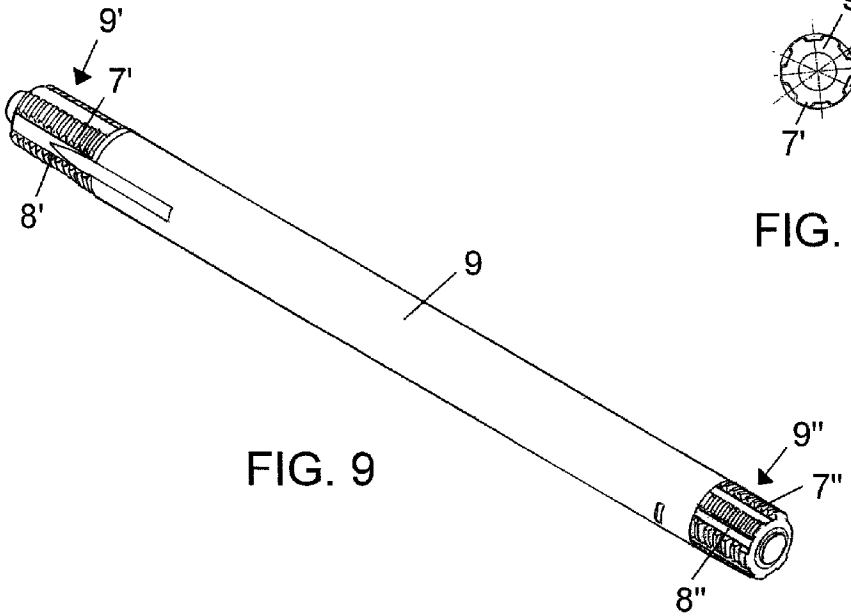

With reference to the number references of the accompanying drawings, the improved device 1 according to the present invention comprises a hydraulic cylinder 2 performing a rectilinear reciprocating movement, and supporting a device 4 including an auxiliary hydraulic or pneumatic cylinder 5 having a seat or recess 6 for housing a rear end portion of a slotted tie-rod 9.

Said slotted tie-rod, at its rear portion 9', comprises a plurality of parallel tooth elements 7' alternating with longitudinal slots 8'.

Said tie-rod elements comprise, at their other end portions 9", a front portion including a plurality of parallel tooth elements 7 alternating with corresponding series of slotted cavities 8'.

The rear end portion 9' of the slotted rod 9, operating as a tie-rod, is housed in a contoured seat or recess 6.

The housing operation may be performed by collimating or centering the tooth elements 7' of the slotted tie-rod 9 thereby pushing said tie-rod into the slots 18 of the seat or recess 6.

Said tie-rod 9 may be locked, at its rear portion 9', by turning through 45° said tie-rod 9 after having pressed it into its recess.

Thus, the tie-rod tooth elements 7' will engage in the slotted cavities or hollows 18 of the corresponding housing recess or seat 6.

Likewise, for locking the heel element 11 to the front portion 9" of the slotted tie-rod 9, said tie-rod 9 is engaged in the rear portion of the heel element 11, thereby causing the heel element parallel tooth elements 27 to collimate with one another, as the tie-rod 9 is introduced into the heel element 11 with the corresponding longitudinal slots 8" formed in the front portion 9" of the tie rod 9.

The tooth elements 7' at the front portion of the slotted tie-rod 9 have an extension of 30° and are respectively spaced by six longitudinal cavities 8" also having an extension or amplitude of 30°.

In the overall extension corresponding to 360° of the front portion 9" of the slotted tie-rod 9 are thus present six longitudinal cavities 8" having a width or extension of 30°, alternating with six series of parallel tooth elements 7" having a width or extension of 30°.

Said slotted tie-rod 9, at the other end portion 9' thereof, comprises moreover four series of longitudinal slots 8' alternating with four series of parallel tooth elements 7' having an extension or width of 45°.

Thus, the assembling of the heel element 11 on the rear portion 9" of the tie-rod 9 is performed by collimating or centering the parallel tooth elements 7" of the tie-rod 9 with the longitudinal cavities or recesses 28 formed in the seat 13 of the heel element 11.

After having performed the above operation, the tooth elements 7" of the tie-rod 9 are engaged in the cavities 28 of the seat 13 of the heel element 11.

The locking of the heel element 11 on the tie-rod 9 is performed by causing the tie-rod 9 to turn through 30°, thereby engaging the heel element parallel tooth elements 7 with the further tie-rod parallel tooth elements 7".

The above operations are automatically performed by the inventive device 1 since said device comprises an auxiliary cylinder 5 including a pulling piston 22 adapted to axially displace and partially turn through 30° the tie-rod 9.

To remove the heel element 11 from the slotted tie-rod 9 by means of the above auxiliary cylinder 5, the latter is rotatively driven through 30° in an opposite direction to remove the slotted tie-rod 9 from the heel element 11 by a short withdrawing movement of the pulling piston and slotted tie-rod 9 with respect to the heel element 11.

The above two operations are performed by said auxiliary cylinder 5 which may partially turn and perform a short axial translation as pulled by the piston 22.

On the contrary, to assemble the slotted tie-rod 9 and engage it in the slotted cavity 6 of the auxiliary hydraulic piston 5, it is sufficient to turn the slotted tie-rod 9 through 45°, after having engaged the rear tooth elements 8' in the longitudinal slots 28 of the auxiliary cylinder 5.

When, on the contrary, the tie-rod must be replaced, then, by means of the hydraulic or pneumatic pistons 12, the auxiliary cylinder 5 is turned through 45° and withdrawn, to disengage the rear end portions of the slotted tie-rod 9.

As shown, said hydraulic piston 12 drives a rack 20 which partially rotatively drives a gear 21 supporting the slotted tie-rod 7.

The main features of the above disclosed inventive device, with respect to prior like devices, are the following:

1. the movable rod 9 is arranged inside the punch
2. the rod 9 comprises a rear portion having four slots, whereas the front portion is conical and is machined with six unthreaded slots.
3. The tapering facilitates the engaging of the heel element.
4. The difference between the front and rear slots prevents the driven rod from disengaging during the heel element locking operation.
5. Another main feature of the inventive apparatus is the provision of a pneumatic assembly, which, if desired, may also be replaced by an electric assembly.
6. Said device comprises a pulling rear portion, operating as to always hold the heel element (II) in a proper position.

This assembly is arranged in the main piston 2.

The device according to the present invention further comprises a limit or end of stroke system for controlling the rotary movements of the slotted rod 9 with respect to the heel element 11 and recess 6 housing said rod.

The locking and unlocking movements of the heel element 11 may be stored in a suitable control processing unit or in the device rotatively driving the slotted rod 9 with respect to its housing seat or recess and heel element 11.

Thus, the inventive device allows to perform in a fully automatic manner the replacement operations of the heel element 11.

Accordingly, the invention solves a very important problem occurring in the replacement step of the heel element 11 in metal and metal alloy extruding press assemblies.

While the inventive device has been hereinabove disclosed and shown as an illustrative but not limitative example of the invention, said device is susceptible to many modifications and variations which will fall within the scope of the invention.

The invention claimed is:

1. An improved device for application to metal material extruding press assemblies, for quickly replacing a heel element and/or a slotted tie-rod element applied to the press assemblies, characterized in that said device comprises a hydraulic cylinder for driving the slotted tie-rod element and that said heel element supports an auxiliary hydraulic or pneumatic cylinder having a recess for engaging therein a rear end portion of said slotted tie-rod element and that said auxiliary cylinder comprises an auxiliary cylinder pushing piston designed for performing a longitudinal translation and rotary movement thereby allowing said slotted tie-rod element and/or heel element to be assembled and disassembled.

2. A device, according to claim 1, characterized in that said slotted tie-rod element comprises, at a rear portion thereof, a plurality of parallel tooth elements alternatively arranged with longitudinal slots and, at the other portion thereof, a front portion including a plurality of parallel tooth elements alternating with a series of said slots.

3. A device, according to claim 1, characterized in that said device comprises a slotted tie-rod element having a rear end portion engaged in a correspondingly contoured and sized recess formed in said auxiliary cylinder, by correspondingly mutually fitting the parallel tooth elements of the slotted tie-rod element to press said slotted tie-rod element into said recess.

4. A device, according to claim 1, characterized in that said slotted tie-rod element is adapted to be locked at its rear portion by rotatively driving through 45° said tie-rod element after having press engaged said tie-rod element in said recess thereby causing said tooth elements thereof to engage in said cavities and with the tooth elements of the corresponding housing or engaging recess.

5. A device, according to claim 1, characterized in that said device allows to lock said heel element to a front portion of said slotted tie-rod element by engaging the rear portion of said heel element in said slotted tie-rod element so as to cause the front tooth elements of the heel element to correspondingly fit, as the tie-rod element is engaged in said heel element, with corresponding longitudinal slots formed in the front portion of the tie-rod element, the locked connection being achieved by causing said slotted tie-rod element to turn through 30° with respect to said heel element.

6. A device, according to claim 1, characterized in that said tooth elements formed on the front portion of said slotted tie-rod element have a 30° width and being spaced by six longitudinal cavities, also having a 30° width, thereby, through the full 360° extension of the front portion of the slotted tie-rod element six longitudinal cavities of a 30° width alternating with six series of parallel tooth elements having a 30° width or amplitude are provided.

7. A device, according to claim 1, characterized in that said tie-rod element comprises, at the other rear portion thereof, four series of longitudinal slots alternating with four series of parallel tooth arrangements having a 45° width or amplitude.

8. A device, according to claim 1, characterized in that said heel element is assembled on the rear portion of said tie-rod element by correspondingly fitting the parallel tooth element series of the tie-rod element with the longitudinal cavities formed in a recess of the heel element and by successively engaging the tooth element series of the tie-rod element in the recess of the heel element while causing the pushing piston of the auxiliary cylinder to be fed and rotatively driven through 30°.

9. A device, according to claim 1, characterized in that said auxiliary cylinder is designed for axially driving and partially rotating said slotted tie-rod element through 30° and that the heel element may be disassembled from the slotted tie-rod element by causing the auxiliary cylinder to be oppositedly rotated through 30° and withdrawing the slotted tie-rod element from the heel element by performing a short back movement of the slotted tie-rod element by a pushing or pressing piston with respect to the heel element.

10. A device, according to claim 1, characterized in that, for assembling the slotted tie-rod element with respect to a slotted cavity formed in said auxiliary piston, said slotted tie-rod element is rotated through 45° after having engaged the rear tooth elements of said slotted tie-rod element in the longitudinal slots of said auxiliary piston.

11. A device, according to claim 1, characterized in that said device comprises further hydraulic pistons for replacing said slotted tie-rod element, said hydraulic pistons driving a rack engaging with a gear element to cause the auxiliary cylinder to perform a 45° rotary movement so as to also disengage the rear end of the slotted tie-rod element.

12. A device, according to claim 1, characterized in that the rod is arranged in a punch assembly and has the rear portion thereof machined with four slots and a conical front portion thereof machined with six slots and free of threads, to provide a conic arrangement facilitating an engagement of the heel element, an angular difference between the front and rear slots preventing the movement of the slotted tie-rod element, during the unlocking operation of the heel element, from unlocking also the slotted tie-rod element.

13. A device, according to claim 1, characterized in that said auxiliary cylinder is a pneumatic or hydraulic or electric auxiliary cylinder comprising a drawing rear portion for always holding the heel element at a proper position and a front rotary locating portion, this assembly being supported by the main hydraulic cylinder.

14. A device, according to claim 1, characterized in that said device comprises a movement and position end of stroke control or limit system.

15. A device, according to claim 1, characterized in that the heel element engaging and locking/unlocking steps are synchronously performed to allow a full automation of the heel element replacing procedure.

* * * * *